US006481417B2

(12) United States Patent
Holtzman

(10) Patent No.: US 6,481,417 B2
(45) Date of Patent: Nov. 19, 2002

(54) SUPPLEMENTAL FUEL SYSTEM FOR A MULTI-CYLINDER ENGINE

(76) Inventor: Barry L. Holtzman, 3907 Evergreen Rd., Eagle River, WI (US) 54521

( * ) Notice: Subject to any disclaimer, the term of this patent is extended or adjusted under 35 U.S.C. 154(b) by 0 days.

(21) Appl. No.: 09/817,704

(22) Filed: Mar. 26, 2001

(65) Prior Publication Data

US 2002/0134327 A1 Sep. 26, 2002

(51) Int. Cl.[7] ..... F02B 7/00

(52) U.S. Cl. ..... 123/431; 123/73 A; 123/580; 123/DIG. 5

(58) Field of Search ..... 123/73 A, 73 B, 123/73 CB, DIG. 5, 580, 179.9, 431

(56) References Cited

U.S. PATENT DOCUMENTS

| | | | |
|---|---|---|---|
| 4,284,040 A | 8/1981 | Baltz | 123/187.5 R |
| 4,508,068 A | 4/1985 | Tuggle et al. | 123/187.5 R |
| 4,694,792 A | 9/1987 | Uuskallio | 123/187.5 R |

*Primary Examiner*—Noah P. Kamen

(57) ABSTRACT

This invention provides a low cost, easily installed means of supplying supplemental fuel to an engine for the purpose of cold starting and enrichment, which also functions as a means for manual operator adjustment of low speed fuel flow. This system is easily adjusted by the operator while driving, requiring only one adjustment for a multi-cylinder engine. This system reduces the fuel delivery imbalance caused by the phase relationships of the fuel pressure pulses and the pressure pulses existing at the outlets of its fuel delivery orifices by using orifices of different areas.

9 Claims, 1 Drawing Sheet

SUPPLEMENTAL FUEL SYSTEM FOR A MULTI-CYLINDER ENGINE

BACKGROUND

1. Field of Invention

Figure 1:
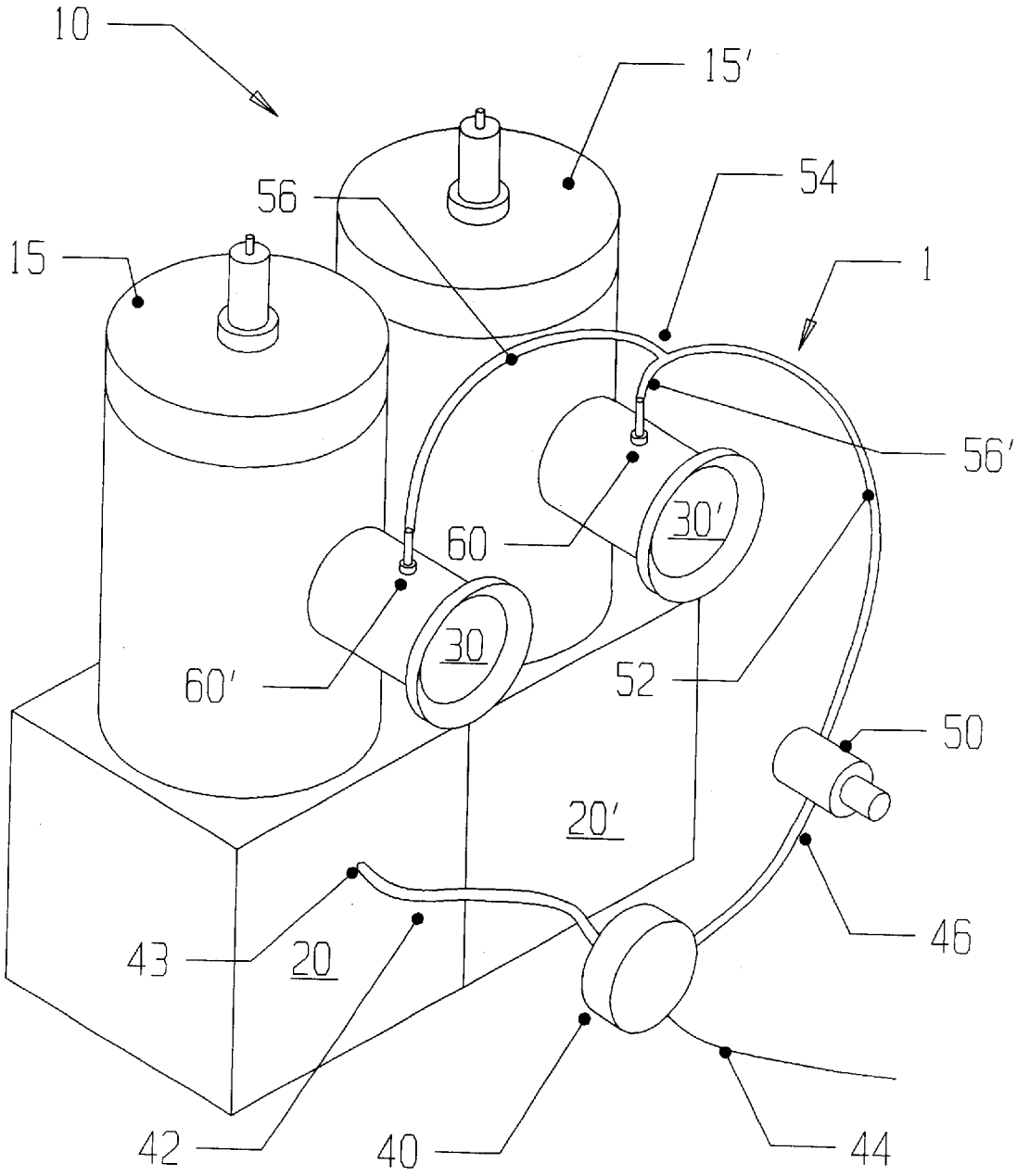

This invention is a supplemental fuel system for an internal combustion engine with more than one cylinder. Under normal operating conditions, the engine receives a substantial portion of its fuel from a primary fuel system, this primary system typically using carburetion or fuel injection. This supplemental fuel system provides fuel to the engine in addition to that supplied by the primary system. The quantity of supplemental fuel supplied to each cylinder is varied depending on the position of a valve and the size of an orifice in a fuel nozzle to each cylinder. This supplemental fuel system provides the functions of cold engine starting and enrichment until the engine warms to its normal operating temperature, and by adjusting relative fuel flow between cylinders, it is also useful as a tuning mechanism for the primary fuel system, especially at low engine speeds.

BACKGROUND

2. Description of Prior Art

Fuels used commonly in internal combustion engines, in a normal operating fuel/air mixture ratio, are not easily ignited when cold. When cold, the fuel/air ratio must be enrichened, supplying more fuel in relation to air than would normally be used in a warm engine, to allow ignition by an ignition source such as a spark plug. Therefore, many starting and enrichment systems have been developed which are used to provide extra fuel to the engine for starting and initial cold operation.

One method of starting and subsequent enrichment used with a carburetor is a choke, which is a second throttle plate positioned before a main throttle plate; closing the choke throttle increases the vacuum seen by the fuel outlets in the carb bore which causes additional fuel to flow to the engine. The choke throttle is normally completely closed for initial starting which provides maximum supplemental fuel flow, and is gradually opened during the engine warming process to gradually diminish the supplemental fuel. This system is well known in the art.

Another method of providing supplemental fuel for cold operation used with carburetors is called an enrichment circuit. This system uses an air passage which bypasses the throttle valve, the air flow through this air passage being regulated by an operator controlled plunger. Fuel from a carburetor float bowl enters this air passage through a fuel orifice, or jet, when the plunger is opened allowing air flow in the passage. The plunger normally is provided with a mechanism to allow the operator to place it in a fully open position providing maximum fuel flow for starting, and a partially open position which provides less additional fuel for enrichment after starting but before the engine has fully warmed. This system is also well known in the art.

Another system used for starting, both with carburetors and with fuel injection, uses a manually operated primer pump in its operation. The suction side of the primer pump is connected to a source of fuel, its pressure side is connected to fuel nozzles commonly placed in the throttle bore, and activating the pump causes fuel to enter the engine for starting. A crude form of enrichment for use after engine starting but before complete warming involves continued intermittent operation of the primer pump, providing additional "squirts" of fuel to the engine while running. This system is somewhat unsatisfactory, however, since continual operator attention is required. Also, insufficient pumping allows the engine to quit running, while too much pumping causes the engine to flood. This system is also well known in the art.

Carburetors normally have several fuel circuits to provide the proper fuel flow at all engine operating conditions. Specifically, an engine operated at low speed and load requires a richer mixture than when run at normal operating speed and load. A carburetor circuit supplying fuel primarily for low speed engine operation is called a pilot circuit. This pilot circuit has a fuel passage with a restricting orifice, or pilot jet, connecting the carburetor float bowl to the venturi bore on the engine side of the throttle plate. By so positioning the fuel passage, a high vacuum is placed across the pilot jet at small throttle openings, but a decreased vacuum exists at larger throttle openings. This causes the pilot jet to deliver more fuel at low throttle openings than at higher throttle openings, hence the pilot circuit is able to provide the richer fuel mixture required by the engine at small throttle openings. This pilot circuit is well known in the art.

The pilot system in a carburetor is normally tuned by two methods. The first is simply changing the pilot jet; installing a jet with a small orifice provides a relatively lean mixture, a jet with a larger orifice provides a relatively richer mixture. In addition to changing the pilot jet, the pilot circuit also normally includes an idle mixture screw to modify fuel delivery. This idle mixture screw typically adjusts the needle position in a needle valve, and can take two forms, a fuel screw or an air screw. When the idle mixture screw is a fuel screw, the fuel screw adjusts a needle valve which controls a fuel feed circuit which parallels the pilot jet; opening a fuel screw will provide more fuel to the engine. When the idle mixture screw is an air screw, the air screw adjusts a needle valve which acts as an air bleed in the fuel passage supplying the pilot jet; opening an air screw will cause a decrease in fuel delivery by the pilot circuit. Both of these idle mixture screws are well known in the art.

Tuning the pilot circuit of a carburetor is not as easy as it would first appear, however. pilot jets are normally inside the carburetor, and changing them requires carburetor disassembly. The fuel or air screws are located on the carburetor, and the vehicle must normally be stopped to perform their adjustment. Also, the fuel or air screws are sometimes in locations which are difficult to access, and carburetor removal is sometimes required to adjust the screws.

Fuel injection systems also must provide the functions of starting and cold engine enrichment. Sometimes a primer system described above is used, or sometimes this function is programmed into the fuel injection computer. Also, the fuel enrichment at low engine speeds is normally programmed into the computer, and changing this low speed fuel delivery normally requires computer re-programming. Changing computer programming to adjust these fuel parameters is difficult and normally not within the skill level of the operator.

The applicant has a co-pending application 09/550774 for a mechanical fuel injection system which uses an injection pump installed on each engine cylinder, the pumps being driven by cylinder pressure pulses. For cold starting and enrichment a primer was used, and the pumps have a low-speed fuel adjustment screw. Starting and enrichening the system with the primer was not entirely satisfactory. Because of the nature of the operation of the injection pumps, often one pump would begin pumping fuel and the other would not, requiring stopping the engine and re-priming. Also, intermittent operation of the primer pump during cold engine operation did not always keep both pumps operating. Cold engine enrichment could be accomplished by adjusting the low speed screws on the injector pumps, but since these screws are not normally accessible to the operator, it required repeated stopping of the machine to re-adjust the screws. An improved starting and enrichment system for this mechanical fuel injection system was needed.

It can be seen, therefore, that primary fuel delivery systems for an engine, whether these primary systems use carburetors or fuel injection, would benefit from a supplemental fuel system which would provide the functions of starting, enrichment, and adjustment of fuel flow at low engine speeds. It would also be beneficial if one adjustment could be performed which would modify fuel flow for all engine cylinders, and it would be convenient if this adjustment could be performed by the operator while driving.

OBJECTS AND ADVANTAGES

It is an object of this invention to provide a supplemental fuel delivery system for an internal combustion engine which provides additional fuel for cold starting and enrichment, and adjustment of the low speed fuel flow at normal operating conditions.

It is a further object of this invention that only a single operator adjustment of this supplemental system be required and that this single adjustment can be performed while driving.

Still further objects and advantages will become apparent from a consideration of the ensuing description and drawing.

DRAWING FIGURE

FIG. 1 shows an internal combustion engine containing a supplemental fuel delivery system of this invention.

REFERENCE NUMERALS IN DRAWINGS

1 supplemental fuel system assembly
10 internal combustion engine assembly
15 first engine cylinder
15' second engine cylinder
20 first cylinder engine crankcase
20' second cylinder engine crankcase
30 first cylinder throttle body
30' second cylinder throttle body
40 fuel pump
42 fuel pump impulse conduit
43 fuel pump impulse conduit crankcase connection
44 fuel pump inlet conduit
46 fuel pump outlet conduit to supplemental fuel system
50 valve
52 valve outlet conduit
54 conduit tee
56 conduit to first injection jet
56' conduit to second injection jet
60 first injection nozzle
60' second injection nozzle

DESCRIPTION AND OPERATION—FIG. 1

FIG. 1 shows a supplemental fuel system assembly 1 used with a two-cylinder internal combustion engine assembly 10. Engine assembly 10 contains a first cylinder 15 with a first cylinder crankcase 20 and throttle body 30 and a second cylinder 15' with a second cylinder crankcase 20' and throttle body 30'. A fuel pump 40 is driven by pressure pulses received from first crankcase 20 through impulse conduit 42 connected to crankcase 20 at position 43. Fuel pump 40 receives fuel from a fuel tank (not shown) through inlet conduit 44, delivers fuel to a primary fuel delivery system (not shown) through outlet conduits (not shown), and also delivers fuel to a valve 50 of supplemental fuel assembly 1 through an outlet conduit 46.

Valve 50, normally a needle valve, is used to close/open/regulate fuel flow from pump 40 into valve outlet conduit 52. Fuel flowing in conduit 52 reaches a tee 54 and splits into a conduit 56 to a first injection nozzle 60 and into a conduit 56' to a second injection nozzle 60'.

Operation of FIG. 1 is as follows. Reciprocating motion of pistons (not shown) in engine cylinders 15 and 15' creates pressure pulses in crankcase halves 20 and 20', these pressure pulses creating a pumping action which draws air through throttles 30 and 30'. Fuel from a primary fuel delivery system (not shown), such as a carburetor or fuel injection system, provides fuel to engine 10 which forms a combustible mixture when combined with air drawn through throttles 30 and 30'. Carburetors and some fuel injection systems introduce this fuel into throttle bodies 30 and 30'. Other primary fuel delivery systems, especially some fuel injection systems, introduce this fuel in other engine 10 locations, such as directly into cylinders 15 and 15', or directly into crankcases 20 and 20'. These primary fuel delivery systems and fuel delivery locations are well known in the art.

Fuel pump 40 can be of a kind known as an impulse pump; it is driven by pressure impulses acting on an internal diaphragm, these pressure impulses normally being received from an engine crankcase such as first engine crankcase 20. There is a system of one-way valves, which, working with the movement of the diaphragm, creates a pumping action. The operation of pump 40 is such that there is a pressure applied to outlet conduit 46 when the pressure in crankcase 20 increases, and a vacuum is applied to inlet conduit 44 when the pressure in crankcase 20 decreases. This causes fuel to be drawn into pump 40 through inlet conduit 44 and exit under pressure through outlet conduit 46. It is to be noted that the pressure in pump 40, outlet conduit 46, and finally conduits 56 and 56', is not constant, but has a "ripple" caused by the pumping action. It is also to be noted that this pressure "ripple" in pump 40 and finally conduits 56 and 56' feeding jets 60 and 60' respectively, is essentially in time, or synchronous, with the pressure profile existing in crankcase 20.

Valve 50, preferably a needle valve, controls the size of the restriction which connects fuel pump outlet conduit 46 (which is also the inlet conduit for valve 50) to valve outlet conduit 52 and conduits 56 and 56'. Valve 50 therefore acts as an adjustable orifice connecting nozzles 60 and 60' to pump 40. Injection nozzles 60 and 60' are drilled to provide an operationally effective orifice size. The adjustable effective orifice in valve 50 combined with the orifices in nozzles 60 and 60', is a pressure splitter. This establishes the pressure existing at the inlets of nozzles 60 and 60' relative to the pressure existing in fuel pump 40.

The actual instantaneous fuel flow rate through the orifices in nozzles 60 and 60' is proportional directly to the size (area) of the orifice and proportional to the square root of the instantaneous pressure difference appearing across the orifice. The pressure difference appearing across the orifice in nozzle 60 is the difference between the fuel pressure in conduit 56 and the pressure existing at the outlet of the orifice in nozzle 60. The pressure difference across the orifice in nozzle 60' is the difference between the fuel pressure in conduit 56' (which is essentially the same pressure as that which exists in conduit 56) and the pressure existing at the outlet of the orifice in nozzle 60'.

The operation of engine 10 is such that for locations of outlet nozzle 60 in throttle assembly 30 or in crankcase 20, the pressure profile existing at the outlet of nozzle 60 is in phase, or synchronous, with the pressure profile existing in crankcase 20. Since the fuel pressure ripple existing at the inlet to nozzle 60 is synchronous with the pressure profile in crankcase 20, this means that the pressure profiles at the inlet and outlet of jet 60 are synchronous. The converse is true, however, for nozzle 60' because the inlet pressure to nozzle 60' is still synchronous to the pressure profile of crankcase 20 (the pressure profiles at the inlets to nozzles 60 and 60' are essentially identical due to their connection to a common conduit 52), but the outlet pressure profile at nozzle 60' is asynchronous to the pressure profile in crankcase 20. This is because the outlet pressure at nozzle 60' is synchronous to its own crankcase 20' which is asynchronous to crankcase 20.

These pressure pulsations and their timing have an effect on the fuel flow through nozzles 60 and 60'. The synchronous timing of these pulsations in nozzle 60 tends to reduce the fuel flow relative to the flow through nozzle 60' with asynchronous timing, even if the areas of the orifices of nozzles 60 and 60' are equal. The synchronous timing tends to lower the effective pressure difference across nozzle 60; the asynchronous timing tends to increase the effective pressure difference across nozzle 60'. This can be understood if for instance the difference between two sine waves of equal magnitude and phase angle (synchronous) is compared with the difference between two sine waves of equal magnitude but having a 180 degree difference in phase (asynchronous). Subtraction of the first two of course yields 0. Subtraction of the second two yields a sine wave having twice the magnitude of the original wave.

Of course, the pressure profiles at the exits of nozzles 60 and 60' are not truly sine waves, and the magnitude of the fuel pressure ripple at the entrances to nozzles 60 and 60' is small compared to the average fuel pressure. Nevertheless, the pulsations in these pressures and their relative timing differences causes the fuel flow through nozzle 60 to be lower than the fuel flow through nozzle 60' if the orifices in nozzles 60 and 60' are equal in size. Specifically, it has been found that, in a twin cylinder engine, a nozzle feeding fuel into a throttle body or crankcase will deliver less fuel if it is associated with the same crankcase to which an impulse pump is connected than if it is associated with the opposite crankcase.

A small difference in the fuel flow through nozzles 60 and 60' can be tolerated in the case of cold starting and cold engine enrichment, but it is desirable in most cases that they be close in magnitude. For low speed fuel flow adjustment, in other words when the fuel supplied by nozzles 60 and 60' is used to tune the low speed fuel flow to the engine at normal operating conditions, it is more critical that the fuel flow in nozzles 60 and 60' be close to identical. This is because if the primary fuel delivery system is set up for proper operation at any set of conditions, atmospheric conditions for instance, then changes in the supplemental fuel flow required for changes in (atmospheric) conditions will be the same for different cylinders because they will be affected equally by changes in (atmospheric) conditions.

To fix this problem, the applicant has developed a supplemental fuel delivery system kit which contains necessary connecting tubing and fittings, a needle valve 50, and an assortment of nozzles which can be used for nozzles 60 and 60', this nozzle assortment having orifices with different sizes (areas). After installation, the user of this kit can use different combinations of nozzle orifices for nozzles 60 and 60' to balance the fuel flow to cylinders 15 and 15'. The needle valve 50 supplied is ideally suited to mounting through a dash near the operator so this incremental fuel delivery system can be operated and adjusted while driving, providing a convenient system for cold starting and enrichment, and a system which easily tunes the low speed engine fuel flow for changes in atmospheric conditions, for instance.

This system has been used successfully on a two-stroke cycle two-cylinder engine with applicant's fuel injection system described in co-pending application 09/550774. Nozzles 60 and 60' were located on different occasions either in throttle bodies 30 and 30' or in transfer passages in crankcases 20 and 20' and were readily accessible for changing. Opening needle valve 50 three to five turns, depending on the temperature of the engine, successfully started the engine with reasonable cranking. After starting, the valve could be incrementally closed as the engine warmed, providing enrichment which prevented the engine from stalling when cold. Monitoring of exhaust gas temperatures indicated the relative state of tune of the two cylinders. It was noticed that the cylinder whose crankcase was not supplying impulse to the fuel pump ran colder than the opposite cylinder when the needle valve was opened for low speed fuel adjustment, even when they essentially had identical temperatures with the needle valve closed. This indicated more fuel flow to this first colder cylinder than the opposite warmer cylinder after opening the needle valve Applicant was able to balance the exhaust gas temperatures, and hence the fuel flow, by installing a jet with a smaller orifice to deliver fuel to the first cylinder.

SUMMARY, RAMIFICATION, AND SCOPE

Accordingly, the reader will see that this invention provides a low cost, easily installed means of supplying supplemental fuel to an engine for the purpose of cold starting and enrichment, which also functions as a means for manual operator adjustment of low speed fuel flow. This system is easily adjusted by the operator while driving, requiring only one adjustment for a multi-cylinder engine.

Although the description above contains many specificities, these should not be construed as limiting the scope of the invention but as merely providing illustrations of some of the presently preferred embodiments of this invention. For instance, this invention is applicable to engines with more than two cylinders. Also, many locations are possible for the fuel supply nozzles described, and the pressure pulse time relations may change from those discussed. These conditions can also be remedied with an appropriate combination of nozzle orifice sizes. Thus, the scope of the invention should be determined by the appended claims and their legal equivalents, rather than by the examples given.

I claim:

1. A supplemental fuel delivery system for an internal combustion engine, said engine including:

a primary fuel delivery system, a first cylinder with a first crankcase having a pressure with a first crankcase pressure profile, a second cylinder with a second crankcase having a pressure with a second crankcase pressure profile, a fuel pump receiving pumping action from said first crankcase pressure profile, said fuel pump delivering fuel having a pressure with a fuel pressure profile, said fuel pressure profile having a synchronous time relationship with said first crankcase pressure profile, and said supplemental fuel delivery system including:

a valve receiving from said fuel pump fuel having said fuel pressure profile, a first nozzle having a first nozzle orifice with an inlet and an outlet, a second nozzle having a second nozzle orifice with an inlet and an outlet, said inlets of said first and second nozzle orifices receiving from said valve said fuel having said fuel pressure profile, said inlets thereby having fuel pressure profiles which are essentially equal in magnitude and time, said outlet of said first nozzle orifice having a location for delivering a first fuel quantity to said first cylinder of said engine, said outlet of said second nozzle orifice having a location for delivering a second fuel quantity to said second cylinder of said engine, said location of said outlet of said first nozzle orifice having a first outlet pressure with a first outlet pressure profile having a magnitude and time relationship with said first crankcase pressure profile, said location of said outlet of said second nozzle orifice having a second outlet pressure with a second outlet pressure profile having a magnitude and time relationship with said second crankcase pressure profile, wherein said first and second outlet pressure profiles are essentially equal in magnitude but different in time, and wherein said first fuel quantity delivered to said first cylinder of said engine through said first nozzle orifice is operationally equal to said second fuel quantity delivered to said second cylinder of said engine through said second nozzle orifice and first nozzle orifice and second nozzle orifice have operationally different areas.

2. The supplemental fuel delivery system of claim 1, wherein said engine has exactly two cylinders and wherein said first crankcase pressure profile and said second crankcase pressure profile are different in time by 180 degrees of said engine rotation and said first and second outlet pressures are different in time by 180 degrees of said engine rotation.

3. The supplemental fuel delivery system of claim 1, wherein said valve can be readily adjusted from an operator accessible position.

4. The supplemental fuel delivery system of claim 1, wherein said outlets of said nozzles are in throttle bodies of said engine.

5. The supplemental fuel delivery system of claim 1, wherein said primary fuel delivery system contains carburetion means.

6. The supplemental fuel delivery system of claim 1, wherein said first fuel quantity and said second fuel quantity can be adjusted using said valve to provide operationally effective values of said first and second fuel quantities for the starting of said engine, for the enrichment of said engine when operating at lower than normal operating temperatures, and for the adjustment of the low speed fuel flow to said engine for changes in operating conditions of said engine.

7. The supplemental fuel delivery system of claim 6, wherein said changes in operating conditions are changes in atmospheric conditions.

8. The supplemental fuel delivery system of claim 1, wherein said primary fuel delivery system contains multiple carburetors and said valve can be adjusted to provide operationally effective values of supplemental fuel quantities to all cylinders of said engine for the starting of said engine, for the enrichment of said engine when operating at lower than normal operating temperatures, and for the effective adjustment of the pilot circuits of all said carburetors.

9. The supplemental fuel delivery system of claim 8, wherein said changes in operating conditions are changes in atmospheric conditions.

* * * * *